US008506062B2

(12) United States Patent
Xu

(10) Patent No.: US 8,506,062 B2
(45) Date of Patent: Aug. 13, 2013

(54) TIME LIMITED PRINTING METHOD AND DEVICE

(75) Inventor: Yongyong Xu, Sunnyvale, CA (US)

(73) Assignee: Yongyong Xu, Sunnyvale, CA (US)

( * ) Notice: Subject to any disclaimer, the term of this patent is extended or adjusted under 35 U.S.C. 154(b) by 311 days.

(21) Appl. No.: 12/960,053

(22) Filed: Dec. 3, 2010

(65) Prior Publication Data

US 2011/0090268 A1 Apr. 21, 2011

Related U.S. Application Data

(62) Division of application No. 11/543,340, filed on Oct. 4, 2006, now Pat. No. 7,851,409.

(60) Provisional application No. 60/596,561, filed on Oct. 4, 2005.

(51) Int. Cl.
*B41J 2/01* (2006.01)

(52) U.S. Cl.
USPC ..... 347/86; 347/85; 347/95

(58) Field of Classification Search
USPC ..... 347/100, 95, 96, 21, 20, 9, 101, 14, 347/19, 86, 85, 5; 106/31.6, 31.27, 31.13; 523/160, 161
See application file for complete search history.

(56) References Cited

U.S. PATENT DOCUMENTS

| | | | | |
|---|---|---|---|---|
| 5,922,115 | A * | 7/1999 | Sano et al. | 106/31.32 |
| 2002/0175982 | A1 * | 11/2002 | Isago | 347/100 |
| 2003/0043189 | A1 * | 3/2003 | Rieffel et al. | 345/753 |
| 2003/0232903 | A1 * | 12/2003 | Sato et al. | 523/160 |

* cited by examiner

*Primary Examiner* — Manish S Shah

(57) ABSTRACT

A method of printing a time limited document is disclosed. The method includes the steps of selecting an ink having a fading time, and printing the time limited document using the selected ink. A printer and associated cartridge are also disclosed.

7 Claims, 2 Drawing Sheets

Printing preference with decoloring effect

TIME LIMITED PRINTING METHOD AND DEVICE

CROSS REFERENCE TO RELATED APPLICATIONS

The present application is a divisional application filed under 35 U.S.C. 121 of application Ser. No. 11/543,340, filed on Oct. 4, 2006 and entitled "Time Limited Printing Method and Device", now U.S. Pat. No. 7,851,409, claims priority under 35 U.S.C. 119(e) from provisional patent application Ser. No. 60/596,561, entitled "Time limited printing methods", filed on Oct. 4, 2005, the entire disclosure of which is herein incorporated by reference.

BACKGROUND OF THE INVENTION

1. Field of the Invention

The present invention relates to printing devices such as laser printers, ink jet printers or copying machines which print or copy characters or figures. More specifically, the present invention relates to a printer device which allows recorded items printed or copied on a medium such as paper to disappear or de-color on a timely basis depending on the urgency or priority of the items or how long the tasks need to be resolved or processed.

2. Description of Related Art

In modern office environments, people work with documents with different priorities or deadlines. For example, a manager may have to read dozens of documents every day and process them before the end of the day. Programmers have to read thousands of lines of code; lawyers have to read through the details of cases. All of these tasks require printing the whole of, or a part of, the documents in a format that people can read and process easily.

Before the popularity of computers, people had to print everything on paper to read and process. Now, with the development of personal computers and network technology, more and more people use computers and office automation software to work and process directly within the computer—so called paperless systems. With the help of email, the Internet and instant messengers, this can greatly improve working efficiencies.

However, the computer is not a panacea. Not everyone likes using computers and not all works are suitable for processing by computers. One reason is that the computer monitor screen may contain harmful radiation and may be bad for people's health. Some computer software is still not easy to use. Also, some people just prefer to print long documents on paper and then read the document from the paper without using computers.

Furthermore, reading from the computer screen for too long may harm one's eyes. Paper materials are still useful in many cases, just like even now with emails and many online tools, there are still many meetings held face-to-face due to their ease of use. Printed paper or documents still play an important role in modern society. However, out of the many printed documents, there is only a small percentage that require permanent storage or persistence. The majority of printed materials are for temporary use and can be discarded after being read, reviewed, and processed after a certain time.

On the other hand, many tasks or printed documents have deadlines associated with them. For example, a case needs to be reviewed by the lawyer before the court hearing; a programmer must finish reviewing the source code before release; a scientist must finish reading a paper before continuing his work. However, time management has always been a difficult task for ordinary people. It is always hard for a person to start processing the documents assigned to him if he is not consistently reminded. In this case, if there is a way to push or force the person to finish the work before certain deadlines, the efficiency of the person can be greatly improved.

U.S. Pat. No. 6,905,538 to Auslande entitled "Invisible ink jet inks" discloses a water-based invisible red fluorescent inks providing machine-readable, inverse contrast invisible images that can be printed using conventional ink jet printers. The inks employ rare earth complexed ligand fluorophores having narrow excitation and emission spectra. In one embodiment the images are printed with an ink comprising water and a water-soluble organic fluorescent fluorophore, which when printed and dried on paper is invisible to the eye and fluoresces in the green to infrared range, e.g., from about 550 to 1200 nm, when irradiated with short wave length UV radiation, e.g., from 230 nm to 280 nm. The highly specific excitation and emission rates, coupled with a high inverse contrast on papers of all colors, makes them particularly useful as ink jet inks for postal and other purposes. That patent relates to the steps of making an invisible ink.

U.S. Pat. No. 6,915,103 to Blume entitled "System for enhancing books with special paper" discloses a system for enhancement of books or other reading material including an item of reading material, printed on a substrate having a substantially invisible, machine-readable coordinate grid. A pointing device is configured to detect the coordinate grid on the substrate when placed in proximity thereto. An output device receives input from the pointing device to determine the location of the pointing device relative to the substrate, and provides output corresponding to contents of the reading material at the location. The output may be in the form of audio and/or video. The disclosure relates to the application of invisible inks and invisible, machine-readable coordinate grids in books.

U.S. Pat. No. 4,404,922 to Morane et al. entitled "Ageing indicator" discloses an ageing indicator that compares a closed sachet of one or more closed tubes of a material which is slightly permeable to a fluid contained in the sachet or tube. The rate of permeation of the fluid through the sachet-like assembly tube wall depends upon temperature and time of exposure to that temperature so the quantity of fluid loss is indicative of temperature and time; the ageing capable of then being detected either by measuring a column of the liquid in a tube or by observing the appearance or disappearance of printed indicia in the sachet. The disclosure relates to the use of invisible inks to indicate aging.

U.S. Pat. No. 4,162,164 to Lin entitled "Cyanine dye based high saturation sympathetic ink having time delayed disappearance" discloses an ink that is intensely colored in solution with the vehicle of the ink. The ink "disappears" or becomes invisible to the naked eye after a period of time has elapsed from the application of the ink to a record document. The ink being utilized to identify an unsatisfactory character on a document such as a MICR check which has had an erroneous character printed which must be corrected before being correctly machine read. The patent discloses formulas for making invisible or disappearing ink.

U.S. Pat. No. 5,290,346 to Fujioka discloses an ink for an ink jet printer capable of decoloring a recorded image or changing a color of the recorded image to thereby save resources, improve economy, and improve functionality. As a coloring composition of the ink, an organoboron salt of cyanine dye and an ammonium salt of organoboron are employed in combination. After printing, the recorded image is decolored by irradiating near infrared light emissions onto a recording surface of a recording paper. As a result, the recording paper can be reused. This patent relates to decoloring inks that can be used for printers.

U.S. Pat. No. 5,215,956 to Kawashima entitled "Color changing print" discloses plural areas printed by using plural types of color changing inks which develop into different colors from the substantially invisible colorless state by reaction with a color changing agent. By the emergence of print from colorlessness and by giving changes in the appearing colors, unexpectedness and entertainingness are provided so that an attractive education may be realized. This patent discloses inks that can change colors instead of disappearing.

U.S. Pat. No. 5,104,448 to Kruse entitled "Jet printing ink compositions and methods" discloses jet printing ink compositions characterized as having low volatility, low viscosity and low variation of viscosity with respect to temperature. The compositions comprise a coloring agent dissolved or dispersed in a liquid vehicle which is preferably substantially free of added water and is a propylene glycol ether or an ethylene glycol butyl ether in which the coloring agent is soluble or dispersible. This patent discloses a special kind of disappearing ink.

U.S. Pat. No. 5,568,986 to Sugai entitled "Printer device" discloses a printer device with an erasing portion for erasing recorded items of a medium on which characters or figures have been recorded, and a recording portion for printing or copying the surface of the medium having passed through the erasing portion by color fading ink or toner. This patent relates to printers that use decoloring inks.

U.S. Pat. No. 5,362,592 to Murofushi et al. relates to a decolorizable toner including a resin binder, a near infrared ray-absorbing dye, a decolorizing agent and a light fastness stabilizer, and a process for preparing the decolorizable toner, which includes the steps of mixing the near infrared ray-absorbing dye and the light fastness stabilizer with the resin binder, and then mixing the decolorizing agent therewith. The decolorizable toner has excellent light stability during its production or storage and excellent decolorizing property. This patent relates to decoloring toners for printers.

U.S. Pat. No. 5,922,115 to Sano et al. discloses a decolorizable ink and printer. Decolorizable ink consists of an ink composition dispersed in a solvent, the ink composition comprising a color former, a developer and a decolorizer, wherein the color former and developer are in a colored state by interaction between them and the decolorizer has a property to dissolve preferentially the developer when the ink composition is melted. This patent relates to decoloring ink and printers.

What is needed then is a time limited printing method that can print documents that automatically fade after a certain time to achieve a variety of purposes including improving work efficiency by associating the time with deadlines and paper recycling.

SUMMARY OF THE INVENTION

The present disclosure solves the problems of the prior art by providing a printer device operable to print time-limited documents. The printer device includes a printing or a copying machine which can print, transfer or copy characters and figures by using ink, toner or the like. For example, a laser printer, an ink jet printer, a copying machine and the like are included. The ink includes regular ink, toner or any other chemical substances that are used to record information on a medium or paper.

In accordance with an aspect of the invention, a method of printing a time limited document includes the steps of selecting an ink having a fading time, and printing the time limited document using the selected ink.

In accordance with another aspect of the invention, a printer for printing a time limited document includes an ink cartridge including a first ink and a decoloring agent, separated from the first ink, and a controller for controlling the proportion of the first ink and the decoloring agent, the proportion of the first ink and the decoloring agent determining the duration of the time limited document.

In accordance with yet another aspect of the invention, an ink cartridge for providing a time limited ink includes a first compartment having a first ink, and a second compartment having a decoloring agent.

In accordance with another aspect of the invention, an ink cartridge for providing a time limited ink includes a first ink and a decoloring agent composition, the composition fading within a defined time period.

In accordance with another aspect of the invention, a time limited printing paper includes a paper soaked with a decoloring agent, wherein the decoloring agent is activated in the presence of ink.

There has been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended herein.

In this respect, before explaining at least one embodiment of the invention in detail, it is to be understood that the invention is not limited in its application to the details of functional components and to the arrangements of these components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

These and other aspects and features of the present invention will become apparent to those ordinarily skilled in the art upon review of the following description of specific embodiments of the invention in conjunction with the accompanying figures, wherein.

DETAILED DESCRIPTION

Figure 1:
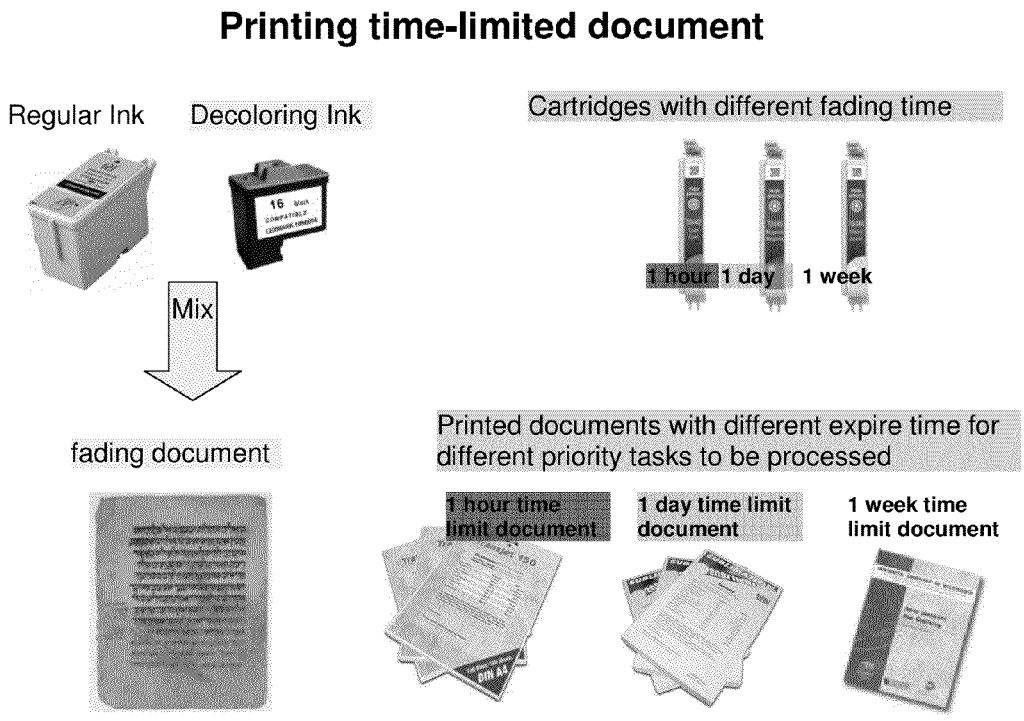
FIG. 1 is an illustration showing the mixing of a regular ink and a decoloring ink to provide a time limited document in accordance with the invention.

The present invention relates to a printer device which allows recorded items printed or copied on a medium (hereinafter referred to as "paper") such as paper to disappear or decolor on a timely basis depending on the urgency or priority of the item or how long the tasks need to be resolved or processed. Two goals can be achieved: the paper may be reused after certain time and working efficiency may be improved. In face, this time limited printing method brings a new use to the existing printing method.

The method of printing documents in a time-limited manner can help so that if the assignee does not process it within a certain time limit, the document might disappear or vanish automatically and he has to take the extra steps of re-printing or re-ordering the document. Driven by such deadlines and pressure, everyone will be able to finish his work as soon as possible, without a long time delay. In some other cases, unlike traditional use of invisible inks or disappearing inks whose only purpose is to protect secret information, this time limited documents can be other types of time-sensitive documents, such as ticket, coupon, or other document that changes value after certain time.

The present invention will now be described in detail with reference to the drawings, which are provided as illustrative examples of the invention so as to enable those skilled in the art to practice the invention. Notably, the figures and examples below are not meant to limit the scope of the present invention. Where certain elements of the present invention can be partially or fully implemented using known components, only those portions of such known components that are necessary for an understanding of the present invention will be described, and detailed descriptions of other portions of such known components will be omitted so as not to obscure the invention. Further, the present invention encompasses present and future known equivalents to the components referred to herein by way of illustration.

In traditional printer (laser or ink jet printer) or copying machine, ink or toner is made of a material that is chemically stable and does not fade in color, so that the recorded characters or figures do not disappear or decolor as time goes on. For example, carbon is adhered or burned to a paper surface so as to record characters or figures. This is normal because the purpose of the printer and copy machine is to print or copy something to the paper so that people can read or keep it for long time.

However, there is also something called invisible ink or disappearing ink on the market. They serve two different kinds of purposes. One kind of invisible ink is used to write or print secret messages that can not be easily detected by human eyes but will be visible when scrabbled, heated, exposed to certain kind of lights, or detected by special equipment. This technique can be used for secret communication or messages, authentication and verification of important documents, money or checks.

Another kind of disappearing ink can be seen in a magic exhibition where the liquid original colored will decolor after being exposed in the air for a certain time. This kind of disappearing ink has not been widely used since it is opposite to the original purpose of ink—which is to persist in information, messages or documents.

Recently, some researchers and other inventors have disclosed method to make use of different ingredients or mixtures of chemical substances to achieve the effect of disappearing ink and make them useful for printers such as ink jet, laser printer or copy machine. Many of them have been listed in background section of this application. Although some of the inks do decolor after a certain time, however, none of the prior art inks have been discovered to allow fading or decoloring in a timely manner that can be used to help to increase people working efficiency and also help reuse the paper.

In the method of the invention, the ink or toner being used by printing devices not only fades after printing, but also fades or decolors at a different speeds so that the fading time can be controlled, determined and preset beforehand when using such ink or toner in printers or copy machines. Of course, sometimes the precision of time control may have variations during this process, say, the color will not be completely invisible after a certain time, but maybe a little bit pale and becomes invisible as time goes by.

In office or company environments, printers or copy machines can be setup to utilize this kind decoloring or fading features to print documents to be processed in different priorities—different time limit or deadline for different tasks. When used in the right way, it can greatly increase work efficiency. The main reason is that if work is not finished by a given time, the user will encounter some kind of "inconvenience"—additional burden will occur if he does not finish the tasks on time as he has to re-print or re-order the document.

This differs from traditional ways of printing priority documents using either "urgent" watermark or letter headers as there is no cost even if the tasks are not finish on time. Another benefit of using the printing method of the invention is that papers used to print such documents can be further reused to save the environment after the material decolor. Furthermore, making the document fade or decolor after a certain time can help preserve trade secrets since it will automatically disappear after a certain time and the paper may not need to be shredded before disposal.

In accordance with the invention, a mixture of regular ink and special decoloring ink, or agent is to be used by the printing device to meet different printing requirements—where the regular ink can be used when people need to print a permanent document as usual. Decoloring ink or agent can be used when people want to print a document that will decolor in a certain time. The decoloring ink can be made of any existing decoloring ink mentioned in the prior art which allows chemical interactions between normal ink and decoloring chemical substance so that the ink will decolor or fade after some time in the air. It can be some type of dissolvent that will erode the regular ink or toner during the interactions. Some of the decoloring ink, or agent can be made of a bleaching agent, oxidant, oxidizer or other decolourant. By mixing and adjusting the percentage and/or with the density of both inks, the fading speed that the ink vanishes and how long the ink will become fully decolored can be controlled and determined.

The printer or copying machine needs to be modified a little bit to include the additional cartridge or toner that is used to contain the decoloring ink or toner. For printers using inks, the decoloring ink can be mixed with the regular ink on or before spreading to the paper, and the predefined percentage of decoloring ink will determine the fading time. (FIG. 1) This is similar to the color printer where different base color inks with different percentages are mixed to achieve different colors. This modification could be easy for ink-jet based printers since the only thing that needs to be done is to add a new ink cartridge and connect along with regular ink cartridge. There are multiple ways to mix inks from different cartridges and any method could be used. For example, using a valve to controls the flow or air pressure to inject the inks. Or, a new small compartment in the existing ink cartridge can be added to hold the decoloring ink so that both can be mixed before spreading by the printer head. For toner based printers, the basis of this method can still be used. Instead of decoloring inks, decoloring toners can be mixed with regular toners before being burned to the paper to achieve the disappearing effect.

Of course, the printer needs a controller to control the new cartridge and to mix of inks. The printer driver will determine the time limit that the final decoloring document will exist according to different priorities. The user who receives such a document may have the urgency, propulsion or incentive to process the document as soon as possible before the time limit expires. Otherwise, the user either has to reprint or reorder the paper copies which entails additional overhead or cost for the overdue work.

Figure 2:
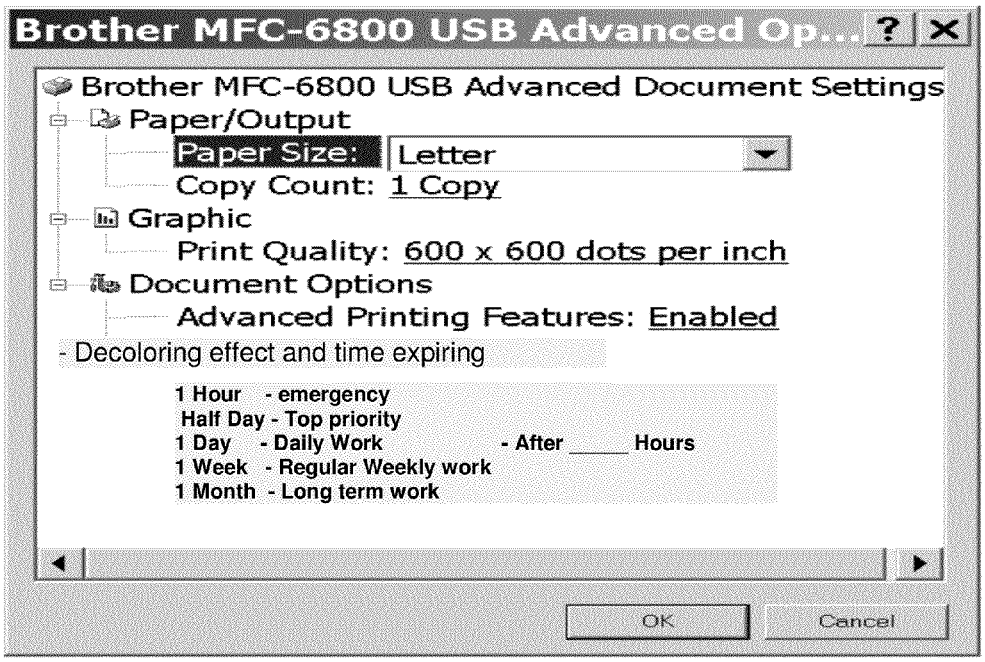
FIG. 2 is an illustration of a user interface for selecting an expiration time of the time limited document base on a priority in accordance with the invention.

Now the control panel for the printing device or printer driver in computers also needs to be modified to support this kind of new feature. (FIG. 2) In additional, in the graphical user interface of the of the printing setup or preference, a new selection needs to be added to allow the user to choose how long the printed document should be preserved. For example, it can be listed from either 1 hour (emergency), half day (top priority work), one day (daily work), 1 week (not so urgent work) or even 1 month depending on whether the printing material can support enough accuracy of time to fade. The printer driver will recognize those time limits and adjust the mixture gate flow controller to control the actual time limit that the printed matter will fade after being printed.

Using this method, whenever somebody prints a document, he can always classify the importance of the document to his work by adjusting the fading time in the printing control. Certainly, in order to remind the user that the document will fade or expire within a certain time frame, other means can be used to distinguish the priority of the document printed such as printer header, document footer or even the paper color—for example, red to indicate expiration within hours and yellow for one day expiration and others for expiration in a week or longer.

This method and technique can work for both black and white printers and color printers. For black and white printers, decoloring inks will be mixed with the black ink and for color printers which normally have 3 or more different base color inks, the decoloring ink could be mixed with those colors either as a group or individually. However, in some color printing, the percentage of different base colors is not the same, and the amount of the decoloring inks may also need to be adjusted so that the same time to fade is still accurate enough to fade. This can be implemented for different types of printers.

In practice, the decoloring process is not a binary operation so that all colors disappear at once after the deadline. It is more like a natural and gradual process that starts immediately after the document is printed. However, before the deadline, the fading effect is not obvious enough so that people can still work on the document. Even after the time limit of the decolored printing expires, the document may still be readable for some period but the printed matter will become weaker and weaker and eventually unreadable and invisible. This is a possible and normal phenomenon and furthermore, the fading of the document with each passing minute can add more pressure to the user or the task assignee while the time limit is approaching and can push him work harder to get it processed before the deadline.

In reality, this technique is most useful for people who print documents that need to be read, reviewed or processed within a certain time limit but is not useful for printing documents that require permanent preservation such as legal documents, stock certificates and the like. In the later cases, the users can either mix with 0 percentage decoloring ink or simply disable the decoloring feature and use regular ink only to print—just as how people print at present.

On the other hand, if some kind of decoloring inks or substances can be deactivated when exposed under certain types of light or radiation like infrared, heat or ultraviolet lights, those time limited documents can be kept longer or even turned into permanent documents by directly exposing the document under such lights for some period. In this manner, people who really cannot finish the documents can save some time from reprinting by taking this additional step to extend the life of this printed document.

After the printed paper becomes decolored and becomes clear again, then the paper can be reused. In this way, an office or company can save a lot of cost spent on the printing paper which is not only a huge cost savings to the companies, but also a huge savings for the trees and the global environment of the earth. If every company starts to use printer equipment using the disclosed printing method, the savings will be enormous for the whole society.

In some cases, the regular ink may not be arbitrarily blended or mixed with the decoloring ink to achieve the timed fading effect during the printing time. For example, there are cases where mixing more decoloring inks cannot shorten fading time, or that the fading effect cannot be simply achieved by mixing two inks. For those cases, we can choose to pre-mix them before printing or use pre-made decoloring ink cartridge or the toner that will decolor after pre-defined time.

However, the disadvantage of this method is that for one pre-filled decoloring ink cartridge, it can only print documents that will expire for the pre-defined time limit. In order to print documents that will fade in another time limit, another pre-made ink cartridge that will expire after another time limit must be used. Of course, a company can sell pre-made ink cartridges which have different time expirations from 1 hour limit to 1 month limit and customers may purchase and use the corresponding cartridges for different tasks. Of course, changing cartridges is needed if the printer can only hold 1 cartridge but may also be impractical if different people have different requirements or time limits.

A solution to this problem includes designing printers which can carry multiple cartridges and each cartridge carries fading ink that will fade for some certain, popularly used time limit. For example, one cartridge is the regular cartridge that never decolors, another one will fade after 1-2 hours, yet another one will fade in 4-8 hours, and yet another one will fade after 1 week. At printing time, the printer driver will prompt the user to select the described fading time frame and command the printer to use the desired cartridge for printing.

A new business can come from this method. Not only decoloring printers and decoloring inks can be sold in the future. Those pre-made decoloring cartridges with different expiration times could also be sold by companies who sell such decoloring cartridges and printers. When people buy the ink cartridge or toner, there is a new parameter to choose from—fading or expiration time, in addition to existing color selection or other parameters.

The pre-filled cartridges with fixed and pre-defined fading times have an additional benefit. The pre-filled cartridges can be compatible with existing printers as long as the liquid can be transferred to the paper in the same way as the original inks. In this way, the regular ink cartridge can be replaced in a normal printer with a decoloring ink cartridge and can print immediately documents with decoloring effect. There is no need to upgrade existing printers—and the only problem may be that a user may have to change cartridges if the user wants to print documents with a different time limit. In this case, a printer cab be dedicated to print all the very urgent documents that expire after 1-2 hours by replacing its original cartridge with the new cartridge that fades in 1-2 hours. This can save a lot of costs in the beginning to replace all existing printers with the new decoloring printers that support printing in different fading time limits.

When the decoloring agent, substances or the bleaching agents, oxidizer can be pre-covered onto or soaked into papers that can be activated or interact with regular ink printed on the paper so that the regular ink will fade on those papers after a certain time, the same fading or decoloring effect can be achieved. Depending on the density of the decoloring substance used to soak the papers, different time limited papers can be made.

Sometimes, we may also soak the paper with inks of different time limits to achieve the same effect. Those papers can be used in normal printers and printed with normal inks. After printing, the regular ink will interact with the decolor substance inside the paper and gradually decolor after some time. This paper may be similar to pre-filled fax papers or colored papers as long as the layer can interact with regular inks and can bleach the inks as time goes on.

It is also possible to sell this kind of "time limited paper"—paper pre-soaked with decoloring ink in the market. Papers with different time limits can also be made in different colors to represent different priorities. One of the best benefits is that people can just buy different time-limited paper and use regular printers to print documents that will expire at different times. Different time-limited color can also be put into different paper trays and use regular printer drivers to select the right tray corresponding to the needed expiration time. This can be extremely simple and easy to use. However, after fading or decoloring, the paper may not be able to re-fade again and may only be used for permanent printing and the efficiency is not as high as the method of using the fading ink cartridge.

It is apparent that the above embodiments may be altered in many ways without departing from the scope of the invention. For example, the system and method of the invention may be used to resolve any dispute between community members. Further, various aspects of a particular embodiment may contain patentably subject matter without regard to other aspects of the same embodiment. Still further, various aspects of different embodiments can be combined together. Accordingly, the scope of the invention should be determined by the following claims and their legal equivalents.

What is claimed is:

1. A printer for printing a time limited document based on a priority of the document comprising:

an ink cartridge including a first ink and a decoloring agent, separated from the first ink; and a controller for controlling the proportion of the first ink and the decoloring agent, the proportion of the first ink and the decoloring agent determining fading time;

and a means to associate the priority of the printing document to the fading time.

2. The printer of claim 1, further comprising a user control interface coupled to the controller.

3. The printer of claim 1, wherein the controller is coupled to a valve, the valve controlling the proportion of the first ink and the decoloring agent.

4. The printer of claim 1, wherein the controller is operable to control a first pressure exerted on the first ink and a second pressure exerted on the decoloring agent, the first and second pressures determining the proportion of the first ink and the decoloring agent.

5. An ink cartridge for providing a time limited ink having a fading time comprising:

a first compartment having a first ink; and a second compartment having a decoloring agent, a composition of the first ink and the decoloring agent fading within the fading time;

wherein the proportion of the first ink and the decoloring agent determining the fading time.

6. An ink cartridge of 5, wherein:

the ink and the decoloring agent are combined into a composition, the composition fading within a defined fading time.

7. A printer for printing a time limited document based on a priority of the document comprising:

a plurality of pre-filled ink cartridges, each pre-filled ink cartridge including an ink having a pre-determined fading time; and a printer driver for selecting one of the plurality of pre-filled ink cartridges based upon the priority of the time limited document, and a means to associate the priority of the printing document to the fading time.

* * * * *